US006497172B2

(12) United States Patent
Hirano et al.

(10) Patent No.: US 6,497,172 B2
(45) Date of Patent: Dec. 24, 2002

(54) ROTARY ACTUATOR WITH CUSHION MECHANISM

(75) Inventors: Akihiro Hirano, Ibaraki (JP); Kenji Koiwa, Ibaraki (JP); Kiyoshi Takeuchi, Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/796,593

(22) Filed: Mar. 2, 2001

(65) Prior Publication Data

US 2001/0018864 A1 Sep. 6, 2001

(30) Foreign Application Priority Data

Mar. 3, 2000 (JP) ..... 2000-058631

(51) Int. Cl.[7] ..... F15B 15/22

(52) U.S. Cl. ..... 91/339; 91/394; 91/409; 92/85 B

(58) Field of Search ..... 91/394, 408, 409, 91/443, 339; 92/120, 121, 122, 123, 124, 125, 143, 80, 82, 85 B; 137/601.19, 601.2

(56) References Cited

U.S. PATENT DOCUMENTS 2,798,462 A * 7/1957 Ludwig et al. ..... 277/345
3,021,822 A * 2/1962 Rumsey ..... 277/345
4,009,639 A * 3/1977 Sabashi ..... 91/25
4,492,150 A * 1/1985 Yates ..... 417/481
4,611,797 A * 9/1986 Cetnarowski ..... 269/57
4,941,554 A * 7/1990 Sollami ..... 188/310
5,269,346 A * 12/1993 Yuda ..... 137/599.01
6,336,390 B1 * 1/2002 Sato et al. ..... 91/406

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A rotary actuator has a cushion mechanism for stopping a vane at a rotational terminal end position in a cushioning manner. The cushion mechanism has first and second openings. The first opening discharges an exhaust air pressed out from a cylinder hole by a rotating vane to an external portion without limiting a flow amount. The second opening discharges the exhaust air to the external portion in a state of limiting a flow amount. A flow amount adjusting mechanism connects to the second opening. The first opening is provided at a position sealed by the vane before the vane of a hole surface in the cylinder hole reaches a rotational terminal end position. The second opening is provided at a position which is not sealed by the vane after the vane reaches the rotational terminal end position.

7 Claims, 3 Drawing Sheets

ROTARY ACTUATOR WITH CUSHION MECHANISM

TECHNICAL FIELD

The present invention relates to a rotary actuator with a cushion mechanism which can stop a normally and inversely swinging and rotating rotor at a rotational terminal end position in a cushioning manner.

PRIOR ART

As one of a rotary actuator generating a rotational force due to an air pressure, there is a vane type actuator. This is structured such that a rotatable rotor is provided in a center portion of a circular cylinder hole formed within a casing, a vane is mounted to the rotor, and the vane is swung and rotated in a normal and reverse direction due to an effect of air pressure, whereby a rotational force thereof is output via the rotor.

The vane type rotary actuator of this kind is generally structured such that the vane is brought into contact with a stopper so as to be stopped at a rotational terminal end position. Accordingly, since the rotor can not stop at the rotational terminal end position in a cushioning manner while the speed thereof is gradually reduced, there are disadvantages that an impact sound is generated at a time of stopping, a deterioration due to abrasion is easily facilitated in the collided portion and the like. Therefore, it is desirable to provide a vane type rotary actuator which can stop the rotor at the rotational terminal end in a cushioning manner.

DISCLOSURE OF THE INVENTION

A main object of the present invention is to provide a rotary actuator of a vane type provided with an air pressure type cushion mechanism.

Another object of the present invention is to provide a vane type rotary actuator having a compact and rational design structure in which a cushion mechanism is assembled within a casing in a compact manner.

In order to achieve the objects mentioned above, in accordance with the present invention, there is provided a rotary actuator having an air pressure type cushion mechanism for stopping a vane at least at one of normal and reverse rotational terminal end positions in a cushioning manner.

The cushion mechanism mentioned above has a first opening for discharging an exhaust air pressed out from a cylinder hole by a rotating vane to an external portion without limiting a flow amount, a second opening for discharging the exhaust air to the external portion in a state of limiting a flow amount and a flow amount adjusting mechanism for limiting a flow amount, the flow amount adjusting mechanism being connected to the second opening, wherein the first opening is provided at a position sealed by the vane before the vane of a hole surface in the cylinder hole reaches a rotational terminal end position, and the second opening is provided at a position which is not sealed by the vane after the vane reaches the rotational terminal end position.

In the rotary actuator in accordance with the present invention having the structure mentioned above, since the exhaust air is mainly discharged from the first opening freely when the vane is rotated, the vane rotates at a normal speed, however, since the first opening is sealed by the vane when the vane moves close to the rotational terminal end position, the exhaust air is discharged only from the second opening through the flow amount adjusting mechanism in a limited manner. Accordingly, an exhaust pressure is increased, and the vane reaches the rotational terminal end while the speed of the vane is reduced due to a back pressure generated by an increase of the exhaust pressure.

Therefore, in accordance with the present invention, it is possible to obtain a vane type rotary actuator provided with an air pressure type cushion mechanism. Further, since the cushion mechanism can be structured only by assembling a throttle hole, a check valve and the like in a casing and thereafter providing a through hole, a port and the like, it is possible to assemble the cushion mechanism within the casing in a compact manner, so that it is possible to obtain a vane type rotary actuator having a compact and rational design structure.

The actuator in accordance with the present invention may be provided with one vane or two vanes having the structure mentioned above. Further, the cushion mechanism may be set to two pairs of cushion mechanisms for stopping the vane at both normal and reverse rotational terminal end positions in a cushioning manner.

In the actuator provided with one vane, two packings are mounted to the vane. On the contrary, in the cushion mechanism, the first opening for discharging the exhaust air without limiting a flow amount is provided at a position sealed between the two packings before the vane reaches the rotational terminal end position, and the second opening for discharging the exhaust air in a state of limiting a flow amount is provided at a position which is not sealed by the packing even after the vane reaches the rotational terminal end position. Then, the first opening is connected to one supply port by the through hole within the casing and the second opening is connected to the same supply port via the flow amount adjusting mechanism.

Further, in the actuator provided with two vanes, the first vane functions for being driven by the air pressure and the second vane functions for operating the cushion. That is, two pressure chambers are formed in both sides of the first vane, the pressure chambers are respectively connected to the supply port, and the compressed air is alternately supplied to both pressure chambers from the supply port, whereby the first vane and the rotor are normally and inversely swung and rotated. Further, two cushion chambers are formed in both sides of the second vane, and one or both of the cushion chambers is directly connected to a breathing port through the first opening in the cushion mechanism and is connected to the breathing port via the second opening and the flow amount adjusting mechanism. Further, the first opening is provided at a position shut from the cushion chamber by the second vane before the second vane reaches the rotational terminal end position, and the second opening is provided at a position which is not sealed by the second vane even after the second vane reaches the rotational terminal end position. In the case that two sets of cushion mechanism having the structure mentioned above, it is desirable that these cushion mechanism commonly have one first opening and one breathing port, and the first opening is structured such as to be positioned at a center of swing area of the second vane.

In accordance with a particular embodiment, the flow amount adjusting mechanism is formed by a throttle hole, and a check valve which prevents the exhaust air discharged from the cylinder hole from flowing but allows a flow of a supplied air flowing into the cylinder hole from an external portion is provided in parallel to the throttle hole.

In accordance with another particular embodiment of the present invention, a valve chamber communicating with the second opening is formed in the casing and a hole member having the throttle hole is received within the valve chamber via a lip seal forming the check valve between the lip seal and a chamber wall, whereby the throttle hole and the check valve are assembled within the valve chamber.

DETAILED DESCRIPTION

Figure 1:
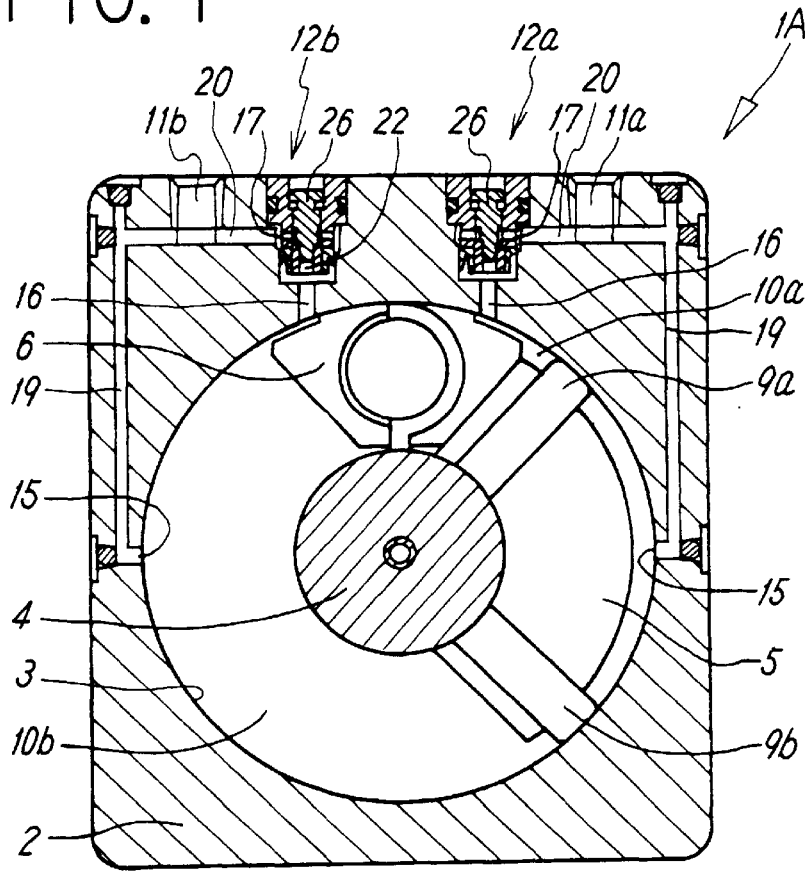
FIG. 1 is a cross sectional view showing a first embodiment in accordance with the present invention.

A description will be in detail given below of embodiments in accordance with the present invention with reference to the accompanying drawings. At a time of describing the embodiments, the same reference numerals are attached to the elements having the same functions.

Figure 2:
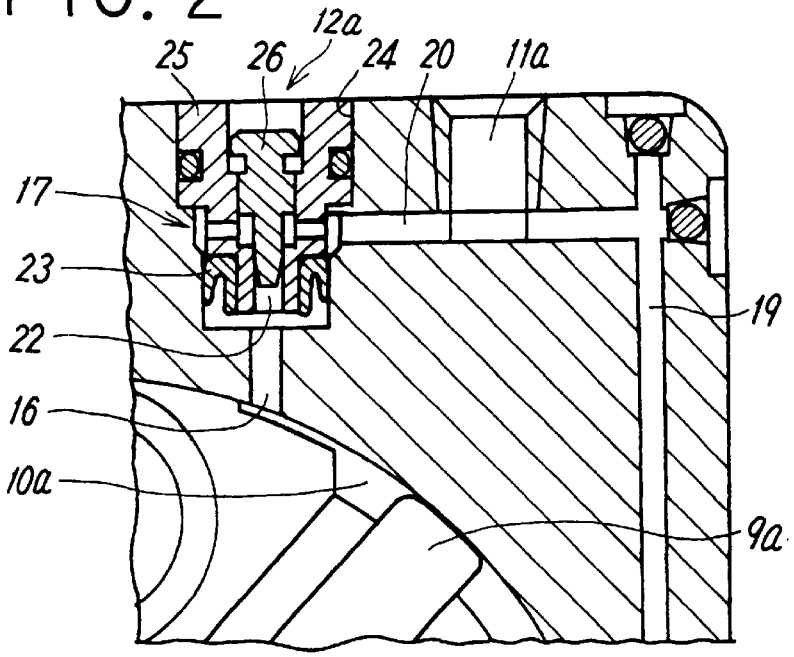
FIG. 2 is an enlarged view of a main portion in FIG. 1.

FIGS. 1 and 2 show a first embodiment of a vane type rotary actuator in accordance with the present invention, and the actuator 1A has a rectangular block-shaped casing 2. A circular cylinder hole 3 is formed within the casing 2*a* rotor 4 rotatably supported to the casing 2 is provided in a center of the cylinder hole 3, and one fan-shaped vane 5 swinging and rotating in normal and reverse directions within the cylinder hole 3 is mounted on a side surface of the rotor 4. Further, within the cylinder hole 3, a stopper 6 for defining a rotational terminal end position of the vane 5 is provided between the hole surface of the cylinder hole 3 and the rotor 4 in an airtight manner.

Two packings 9*a* and 9*b* being in slidable contact with the cylinder hole 3 in an airtight manner are mounted at different positions in the vane 5, and first and second pressure chambers 10*a* and 10*b* are formed between the vane 5 and the stopper 6 by these packings 9*a* and 9*b*.

First and second supply ports 11*a* and 11*b* for individually supplying a compressed air to two pressure chambers 10*a* and 10*b* are provided on one side surface of the casing 2, and first and second sets of air pressure type cushion mechanisms 12*a* and 12*b* for stopping the vane 5 at the rotational terminal end positions in both of the normal and reverse directions in a cushioning manner are provided within the casing 2.

Each of the cushion mechanisms 12*a* and 12*b* has a first opening 15 for discharging an exhaust air pressed out from the pressure chambers 10*a* and 10*b* by the rotating vane 5 to the external portion without limiting a flow amount, a second opening 16 for discharging the exhaust air to the external portion in a state of limiting the flow amount, and a flow amount adjusting mechanism 17 for limiting the flow amount, the flow amount adjusting mechanism 17 being connected to the second opening 16. The first opening 15 is provided at a position sealed between two packings 9*a* and 9*b* before the vane 5 reaches the rotational terminal end position on the hole surface of the cylinder hole 3, and is directly connected to one supply port 11*a* or 11*b* by a through hole 19 within the casing 2. Further, the second opening 16 is provided at a position which is not sealed by the packings 9*a* and 9*b* even after the vane 5 reaches the rotational terminal end position, and is connected to the supply port 11*a* or 11*b* which is commonly used for the first opening 15, by a through hole 20 via the flow amount adjusting mechanism 17.

The flow amount adjusting mechanism 17 is formed by a throttle hole 22, a check valve 23 preventing the exhaust air from flowing without passing through the throttle hole 22 is connected in parallel to the throttle hole 22, and the throttle hole 22 and the check valve 23 are received within a valve chamber 24 formed in the casing 2. That is, the valve chamber 24 communicated with the second opening 16 and the supply port 11*a* or 11*b* is formed on the side surface of the casing 2, a cylindrical hole member 25 in which a diameter thereof is reduced toward a front end step by step is received within the valve chamber 24, the throttle hole 22 is provided in the hole member 25, and a lip seal forming the check valve 23 is interposed between an outer peripheral surface of a front end portion of the hole member 25 and an inner peripheral surface of the valve chamber 24.

The throttle hole 22 is formed so as to connect the second opening 16 to the supply port 11*a* or 11*b,* and is structured such that an opening area thereof can be adjusted by a needle 26 mounted to the hole member 25. Accordingly, the throttle hole 22 is of a variable throttle type capable of adjusting a flow amount of the exhaust air.

On the contrary, the check valve 23 is structured such as to prevent the exhaust air discharged from the pressure chamber 10*a* or 10*b* except the exhaust air flowing to the supply port 11*a* or 11*b* through the throttle hole 22 from flowing in a cushion stroke at a rotational terminal end of the vane 5, and to freely flow the compressed air from the supply port 11*a* or 11*b* into the pressure chamber 10*a* or 10*b* at a time of starting the rotation of the vane 5.

A description will be given of an operation of the rotary actuator 1A having the structure mentioned above. When supplying the compressed air to the first port 11*a* in a state that the vane 5 and the rotor 4 exist at a first rotational terminal end position shown in FIG. 1, the compressed air flows into the valve chamber 24 from the through hole 20, and presses and opens the check valve 23 so as to flow into the first pressure chamber 10*a* from the second opening 16, so that the vane 5 and the rotor 4 starts forward rotating in a clockwise direction in FIG. 1.

Further, when the packing 9*a* positioned at a back side in a rotational direction of the vane 5 moves over the first opening 15, the compressed air is mainly supplied to the first pressure chamber 10*a* through the first opening 15 in a direct manner, so that a rotating operation of the vane 5 is continued as it is. At this time, since the compressed air within the second pressure chamber 10*b* in the front side in the rotating direction of the vane 5 is directly discharged mainly from the first opening 15 in the second cushion mechanism 12*b* through the through hole 19 and the second supply port 11*b,* the vane 5 and the rotor 4 rotate at a predetermined speed.

When the vane 5 moves close to the rotational terminal end and the packing 9*b* in the front side in the rotational direction moves over the first opening 15, the first opening 15 and the second pressure chamber 10*b* are shut, whereby the air within the second pressure chamber 10*b* is discharged from the second opening 16 in the second cushion mechanism 12*b* via the throttle hole 22 in the flow amount adjusting mechanism 17 in a limited manner. Accordingly, the pressure within the second pressure chamber 10*b* is increased, and the increased pressure becomes a vane back pressure so as to take the vane 5 to the second rotational end position brought into contact with the stopper 6 while reducing the speed of the vane 5.

At this time, the packing 9*b* in the front side in the rotational direction of the vane 5 stops in front of the second opening 16 and the packing 9*a* in the rear side in the rotational direction stops in front of the first opening 15. That is, the first opening 15 is sealed between two packings 9*a* and 9*b*.

In the case of rotating the vane 5 and the rotor 4 existing at the second rotational terminal end position in FIG. 1 toward the first rotational terminal end position in a counterclockwise direction, the compressed air is supplied to the second supply port 11*b* and the first supply port 11*a* is open to the open air. Further, when the vane 5 moves close to the rotational terminal end and the packing 9*a* existing in the front side in the rotational direction of the vane 5 passes through the first opening 15, the discharge passage of the compressed air discharged from the first pressure chamber 10*a* is switched from a state of being directly discharged through the first opening 1*b* to a state or being discharged via the second opening 16 of the first cushion mechanism 12*a* and the flow amount adjusting mechanism 17 in a limited manner, the first cushion mechanism 12*a* is operated and the vane 5 stops at the terminal end position while reducing the speed thereof.

Accordingly, the compressed air is alternately supplied to two pressure chambers 10*a* and 10*b* from two supply ports 11*a* and 11*b*, whereby the vane 5 is rotated in an oscillating manner within the cylinder hole 3, and stops in a cushioning manner at the respective stroke ends by the cushion mechanisms 12*a* and 12*b*. Further, the rotor 4 is rotated in an oscillating manner in correspondence to the oscillating rotation of the vane 5.

In the case of stopping the vane 5 only at any one stroke end in a cushioning manner, any one of two cushion mechanisms 12*a* and 12*b* may be omitted.

Figure 3:
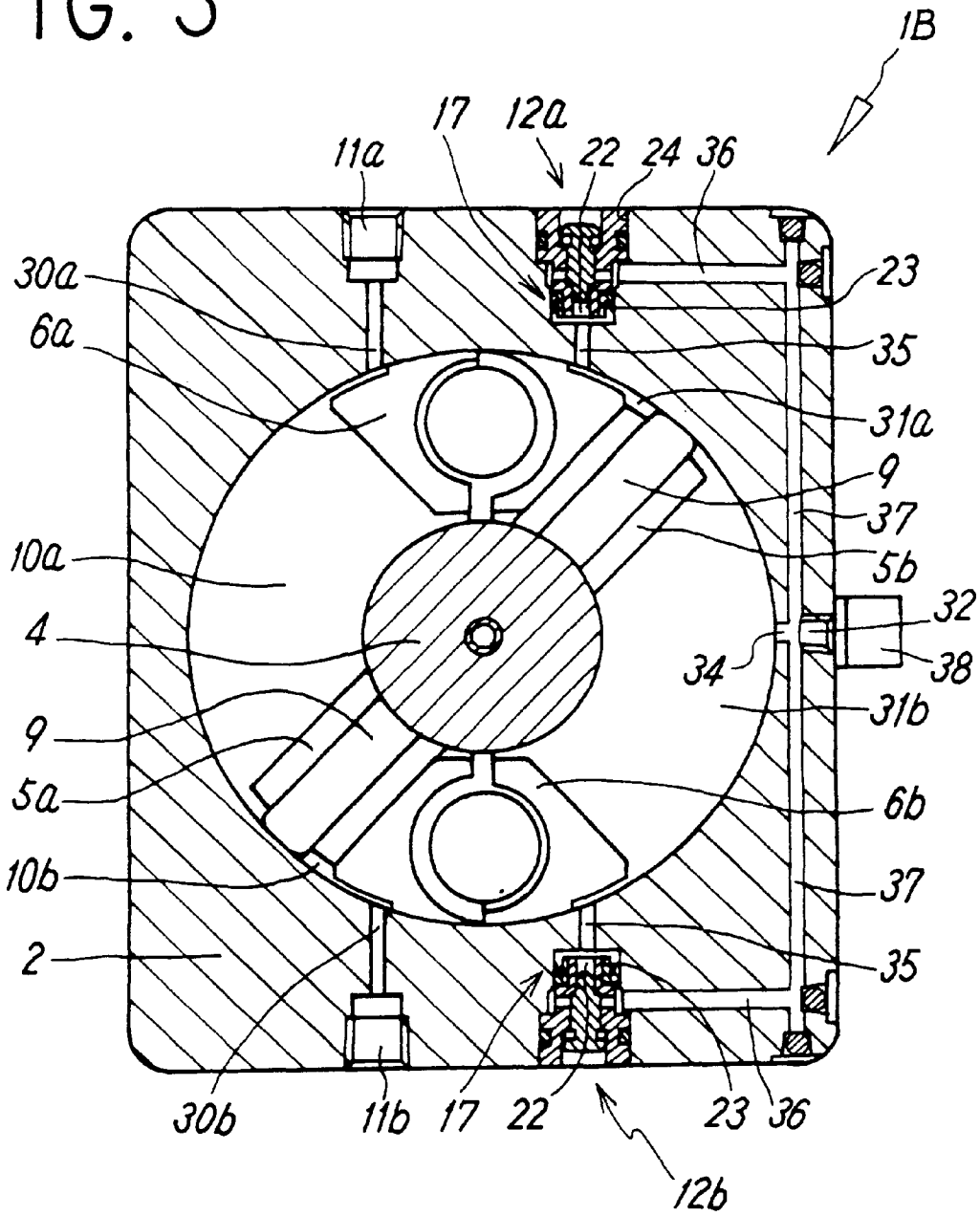
FIG. 3 is a cross sectional view showing a second embodiment in accordance with the present invention.

FIG. 3 shows a second embodiment in accordance with the present invention. A rotary actuator 1B in accordance with the second embodiment is different from the first embodiment in a point that two vanes 5*a* and 5*b* are provided. That is, the actuator 1B has a first vane 5*a* and a second vane 5*b* which are mounted at positions 180 degrees different from each other on a side surface of the rotor 4, and two stoppers 6*a* and 6*b* defining rotational terminal end positions of the respective vanes 5*a* and 5*b*. in FIG. 3, reference numeral 9 denotes a packing mounted to each of the vanes 5*a* and 5*b*.

The first vane 5*a* is structured such as to function for driving the rotor 4 in accordance with an air pressure, the first and second pressure chambers 10*a* and 10*b* are formed between the first vane 5*a* and both of the stoppers 6*a* and 6*b*, the first pressure chamber 10*a* is connected to the first supply port 11*a* through a port hole 30*a*, and the second pressure chamber 10*b* is connected to the second supply port 11*b* through a port hole 30*b*.

Further, the second vane 5*b* is structured such as to function for operating the cushion at the rotational terminal end position of the rotor 4, first and second cushion chambers 31*a* and 31*b* are formed between the second vane 5*b* and both of the stoppers 6*a* and 6*b*, the first cushion chamber 31*a* is connected to a breathing port 32 via a first cushion mechanism 12*a*, and the second cushion chamber 31*b* is connected to the breathing port 32 via a second cushion mechanism 12*b*.

Each of the cushion mechanisms 12*a* and 12*b* has a first opening 34 for discharging the exhaust air from the breathing port 32 without limiting a flow amount of the exhaust air, a second opening 35 for discharging the exhaust air from the breathing port 32 in a state of limiting a flow amount of the exhaust air, and a flow amount adjusting mechanism 17 connected to the second opening 35. Further, the first opening 34 is provided at a position shut from the second opening 35 by the second vane 5*b* before the second vane 5*b* reaches the rotational terminal end position on the hole surface of the cylinder hole 3, and is directly connected to the breathing port 32, and the second opening 35 is provided at a position which is not sealed by the second vane 5*b* even after the second vane 5*b* reaches the rotational terminal end position, and is connected to the breathing port 32 through the flow amount adjusting mechanism 17 and the through holes 36 and 37. In this embodiment, two cushion mechanisms 12*a* and 12*b* commonly use one first opening 34 and one breathing port 32, the first opening 34 is provided at a center position in a swing area of the second vane 5*b*, and the breathing port 32 is provided at a position corresponding to the first opening 34 on a side surface of the casing 2. In FIG. 3, reference numeral 38 denotes a filter mounted to the breathing port 32.

However, at least the first opening 34 among the first opening 34 and the breathing port 32 may be individually provided in each of the cushion mechanisms 12*a* and 12*b*. In the case that the first opening 34 is individually provided in the manner mentioned above, the first opening 34 can be provided at a position close to the rotational terminal end of the second vane 5*b* rather than an illustrated position.

In this case, the structure is the same as that of the first embodiment in a point that the flow amount adjusting mechanism 17 is constituted by the throttle hole 22 and the check valve 23 is connected in parallel to the throttle hole 22.

In the actuator 1B in accordance with the second embodiment having the structure mentioned above, when supplying the compressed air to the second pressure chamber 10*b* from the second supply port 11*b* in a state that each of the vanes 5*a* and 5*b* exists at a first rotational terminal end position shown in FIG. 3, the first vane 5*a* is driven in accordance with the air pressure, and the first vane 5*a*, the second vane 5*b* and the rotor 4 integrally rotate in a clockwise direction in FIG. 3. At this time, the air within the first pressure chamber 10*a* is discharged from the first supply port 11*a* by the first vane 5*a*. Further, the air sucked from the breathing port 32 flows into the first cushion chamber 31*a* in accordance with the rotation of the second vane 5*b* from the through holes 37 and 36 after pressing and opening the check valve 23 within the valve chamber 24, and the air within the second cushion chamber 31*b* is discharged from the breathing port 32 through the first opening 34 and the second opening 35. Accordingly, the rotor 4 rotates at a normal speed in this state.

Further, when the second vane 5*b* moves over the first opening 34, the first opening 34 is shut from the second cushion chamber 31*b*, so that the air within the second cushion chamber 31*b* becomes discharged through the second opening 35 in the second cushion mechanism 12*b* and the flow amount adjusting mechanism 17. Accordingly, the pressure within the second cushion chamber 31*b* is increased due to a flow amount limitation by the throttle hole 22, and the pressure increase becomes a back pressure of the second vane 5*b* so as to take the second vane 5*b* and the rotor 4 to the second rotational terminal end while reducing the speed of the second vane 5*b* and the rotor 4.

In the case of rotating the rotor 4 from the second rotational terminal end position toward the first rotational terminal end position in a counterclockwise direction, the compressed air is supplied to the first pressure chamber 10*a* from the first supply port 11*a* and the second supply port 11*b* is open to the open air. Further, when the second vane 5*b* passes through the first opening 34, the discharge passage of the air discharged from the first cushion chamber 31*a* is switched from a state of being directly discharged through the first opening 34 to a state of being discharged via the second opening 35 of the first cushion mechanism 12*a* and the flow amount adjusting mechanism 17 in a limited manner, so that the rotor 4 stops at the terminal end position while reducing the speed thereof.

Accordingly, as mentioned above, it is possible to obtain the vane type rotary actuator having a simple structure and a compact and rational design structure only by providing the flow amount adjusting mechanism 17 and a plurality of openings in the casing 2 so as to satisfy a particular positional relation.

Figure 4:
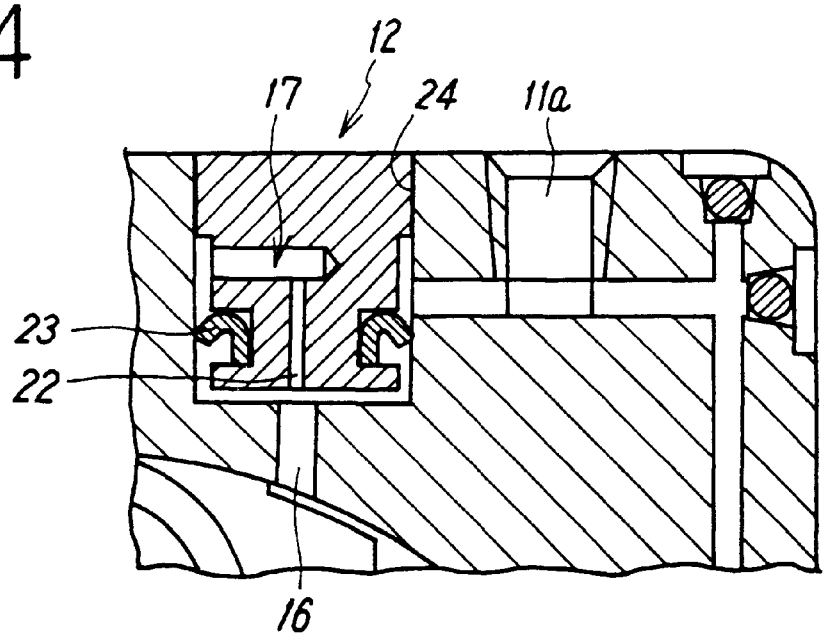
FIG. 4 is a cross sectional view of a main portion showing another embodiment of a flow amount adjusting mechanism.
Figure 5:
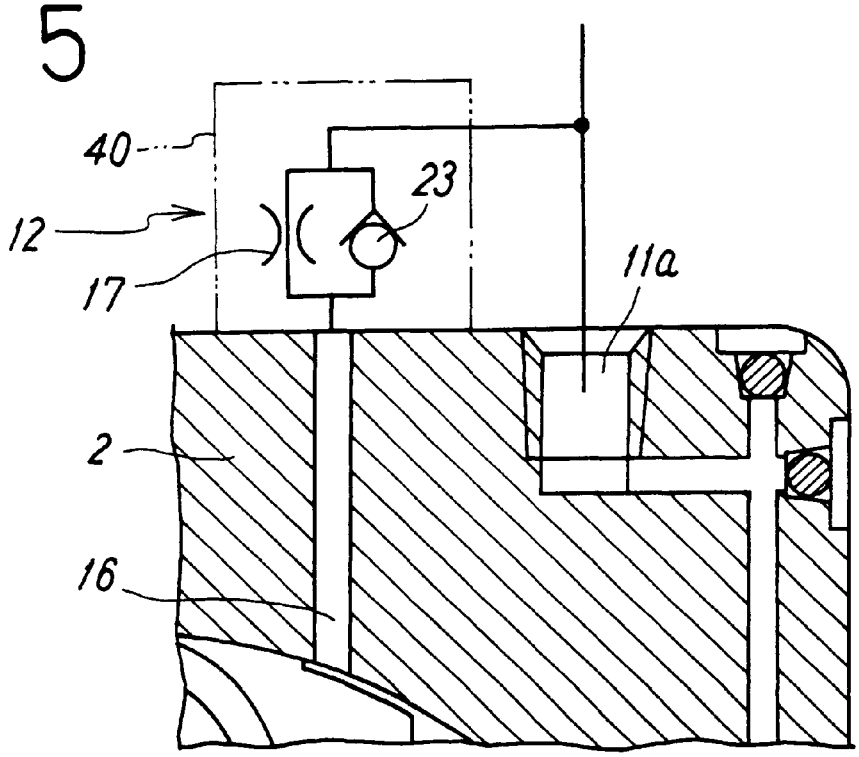
FIG. 5 is a cross sectional view of a main portion showing the other embodiment of the flow amount adjusting mechanism.

FIGS. 4 and 5 representatively show the other embodiments of the cushion mechanism which can be applied to the actuator in accordance with the present invention, in the case that the cushion mechanism is applied to the actuator in accordance with the first embodiment. A cushion mechanism 12 shown in FIG. 4 is different from the first and second embodiments in a point that the throttle hole 22 in the flow amount adjusting mechanism 17 is of a stationary throttle type having no needle.

Further, a cushion mechanism 12 shown in fig. 5 is different from the first and second embodiments in a point that the flow amount adjusting mechanism 17 and the check valve 23 are assembled in a block 40 separated from the casing 2, and the block 40 is attached to the casing 2.

What is claimed is:

1. A rotary actuator with a cushion mechanism comprising:

a circular cylinder hole provided in a casing;

a rotatable rotor provided in a center portion of said cylinder;

one vane mounted to said rotor and swinging and rotating in normal and reverse directions within said cylinder hole;

two packings mounted at different positions on said vane;

a stopper defining a rotational terminal position of said vane;

two pressure chambers formed between said vane and said stopper;

two supply ports for supplying a compressed air to said pressure chambers; and an air pressure type cushion mechanism for stopping said vane at a rotational terminal end position in at least one of normal and reverse directions in a cushioning manner, wherein said cushion mechanism has a first opening for discharging an exhaust air pressed out from said pressure chamber by a rotating vane to an external portion without limiting a flow amount, a second opening for discharging the exhaust air to the external portion in a state of limiting a flow amount and a flow amount adjusting mechanism for limiting a flow amount, said flow amount adjusting mechanism being connected to said second opening, and wherein said first opening is provided at a position sealed between said two packings before said vane of a hole surface in said cylinder hole reaches a rotational terminal end position, said second opening is provided at a position which is not sealed between said packings after said vane reaches the rotational terminal end position, said first opening is connected to one of the supply ports by the through hole within the casing, and said second opening is connected to the same supply port via said flow amount adjusting mechanism.

2. A rotary actuator according to claim 1, wherein said flow amount adjusting mechanism is formed by a throttle hole, and a check valve which prevents the exhaust air discharged from the pressure chamber toward the supply port from flowing but allows a flow of a supplied air flowing into the pressure chamber from the supply port is provided in parallel to the throttle hole.

3. A rotary actuator according to claim 2, wherein a valve chamber communicating with said second opening and the supply port is formed in said casing and a hole member having said throttle hole is received within the valve chamber via a lip seal forming said check valve between the lip seal and a chamber wall, whereby said throttle hole and the check valve are assembled within said valve chamber.

4. A rotary actuator with a cushion mechanism comprising:

a circular cylinder hole provided in a casing;

a rotatable rotor provided in a center portion of said cylinder;

first and second vanes mounted to said rotor and swinging and rotating in normal and reverse directions within said cylinder hole;

two stoppers defining rotational terminal positions of said respective vanes;

two pressure chambers formed between said first vane and both of said stoppers;

two supply ports for supplying a compressed air to said respective pressure chambers; and two cushion chambers formed between said second vane and both of the stoppers;

breathing ports for opening said respective cushion chamber to an external portion; and an air pressure type cushion mechanism for stopping said second vane at a rotational terminal end position in at least one of normal and reverse directions in a cushioning manner, wherein said cushion mechanism has a first opening for discharging an exhaust air pressed out from said cushion chamber by a rotating second vane from said breathing port without limiting a flow amount, a second opening for discharging the exhaust air in a state of limiting a flow amount and a flow amount adjusting mechanism for limiting a flow amount, said flow amount adjusting mechanism being connected to said second opening, and wherein said first opening is provided at a position shut from said cushion chamber by said second vane before said second vane of a hole surface in said cylinder hole reaches a rotational terminal end position, and said second opening is provided at a position which is not sealed by said second vane after said second vane reaches the rotational terminal end position.

5. A rotary actuator according to claim 4, wherein said actuator has two sets of cushion mechanisms for stopping the second vane at the rotational terminal end positions in both of the normal and reverse directions in a cushioning manner, the cushioning mechanisms commonly have one first opening and one breathing port, and said first opening is provided in a center of a swing area of the second vane.

6. A rotary actuator according to claim 4, wherein said flow amount adjusting mechanism is formed by a throttle hole, and a check valve which prevents the exhaust air discharged from the cushion chamber toward the breathing port from flowing but allows a flow of a suction air flowing into the cushion chamber from the breathing port is provided in parallel to the throttle hole.

7. A rotary actuator according to claim 5, wherein a valve chamber communicating with said second opening and the breathing port is formed in said casing and a hole member having said throttle hole is received within the valve chamber via a lip seal forming said check valve between the lip seal and a chamber wall, whereby said throttle hole and the check valve are assembled within said valve chamber.

* * * * *